US011377282B2

(12) United States Patent
Bianchi et al.

(10) Patent No.: US 11,377,282 B2
(45) Date of Patent: Jul. 5, 2022

(54) USE OF A TRAY FOR CONVEYING POUCHES FOR FLEXIBLE CONTAINERS AND METHODS AND MACHINES USING SUCH TRAY

(71) Applicant: FILLSHAPE SRL, Zola Predosa (IT)

(72) Inventors: Paolo Bianchi, Parma (IT); Marco Grassilli, Castello d'Argile (IT)

(73) Assignee: I.M.A. INDUSTRIA MACCHINE AUTOMATICHE S.P.A., Ozzano Dell'emilia (IT)

( * ) Notice: Subject to any disclaimer, the term of this patent is extended or adjusted under 35 U.S.C. 154(b) by 402 days.

(21) Appl. No.: 16/321,342

(22) PCT Filed: Jul. 26, 2017

(86) PCT No.: PCT/IB2017/054538
§ 371 (c)(1),
(2) Date: Jan. 28, 2019

(87) PCT Pub. No.: WO2018/020437
PCT Pub. Date: Feb. 1, 2018

(65) Prior Publication Data

US 2019/0168939 A1 Jun. 6, 2019

(30) Foreign Application Priority Data

Jul. 28, 2016 (IT) ..... 102016000079213

(51) Int. Cl.
*B65D 71/70* (2006.01)
*B65B 3/04* (2006.01)
(Continued)

(52) U.S. Cl.
CPC ..... *B65D 71/70* (2013.01); *B31B 70/98* (2017.08); *B65B 3/04* (2013.01); *B65B 5/068* (2013.01);
(Continued)

(58) Field of Classification Search
CPC ..... B65B 5/068; B65B 3/04; B65B 5/105; B31B 70/98; B65D 1/36; B65D 21/045; B65D 25/107
See application file for complete search history.

(56) References Cited

U.S. PATENT DOCUMENTS 3,589,511 A 6/1971 Britt
3,653,495 A * 4/1972 Gray ..... B65D 5/5253 206/746
(Continued)

FOREIGN PATENT DOCUMENTS

GB 2038270 A 7/1980
JP H10250715 A 9/1998
(Continued)

OTHER PUBLICATIONS

International Search Report dated Nov. 8, 2017 re: Application No. PCT/IB2017/054538, pp. 1-5, citing: JP H 10 250715 A, U.S. Pat. No. 6,854,588 B1, US 2014/197065 A1, GB 2 038 270 A, U.S. Pat. No. 3,589,511 A and WO 92/00888 A1.
(Continued)

*Primary Examiner* — Andrew M Tecco
*Assistant Examiner* — Nicholas E Igbokwe
(74) *Attorney, Agent, or Firm* — Cantor Colburn LLP

(57) ABSTRACT

A tray and its use for conveying pouches for flexible containers such as Doypacks includes a number of partitions that protrude from the base of the tray so as to form between them spaces for the transverse containment of packs of pouches for flexible containers. The containment spaces are used to contain the packs of pouches in a direction that is transverse to the partitions.

11 Claims, 6 Drawing Sheets

(51) Int. Cl.

| | |
|---|---|
| ***B65B 5/06*** | (2006.01) |
| ***B65D 1/36*** | (2006.01) |
| ***B65D 21/04*** | (2006.01) |
| ***B65D 25/10*** | (2006.01) |
| ***B65D 75/00*** | (2006.01) |
| ***B65B 5/10*** | (2006.01) |
| ***B31B 70/98*** | (2017.01) |

(52) U.S. Cl.
CPC ..... *B65B 5/105* (2013.01); *B65D 1/36* (2013.01); *B65D 21/045* (2013.01); *B65D 25/10* (2013.01); *B65D 25/107* (2013.01); *B65D 75/008* (2013.01)

(56) References Cited

U.S. PATENT DOCUMENTS

| | | | | |
|---|---|---|---|---|
| 3,971,629 | A * | 7/1976 | Buix | A23L 3/001 422/302 |
| 5,927,498 | A * | 7/1999 | Saam | B65D 5/52 206/499 |
| 6,129,211 | A * | 10/2000 | Prakken | B65D 5/5253 206/526 |
| 6,854,588 | B1 | 2/2005 | Blattner et al. | |
| 7,017,746 | B2 * | 3/2006 | Apps | B65D 1/243 206/509 |
| 2003/0216235 | A1 | 11/2003 | Resterhouse | |
| 2006/0048486 | A1 * | 3/2006 | Laing | B65D 31/02 53/469 |
| 2014/0197065 | A1 * | 7/2014 | Prince | B65D 21/0213 206/503 |

FOREIGN PATENT DOCUMENTS

| | | | |
|---|---|---|---|
| WO | 9200888 | A1 | 1/1992 |
| WO | 2016034956 | A1 | 3/2016 |

OTHER PUBLICATIONS

IT Search Report dated May 30, 2017 re: Application No. IT 201600079213, pp. 1-8, citing: U.S. Pat. No. 6,854,588 B1, JP H 10 250715 A, US 2014/197065 A1, GB 2 038 270 A, U.S. Pat. No. 3,589,511 A and WO 92/00888 A1.

Written Opinion dated Nov. 8, 2017 re: Application No. PCT/IB2017/054538, pp. 1-6, citing: JP H 10 250715 A and U.S. Pat. No. 6,854,588 B1.

* cited by examiner

USE OF A TRAY FOR CONVEYING POUCHES FOR FLEXIBLE CONTAINERS AND METHODS AND MACHINES USING SUCH TRAY

TECHNICAL FIELD

The present disclosure relates to the use of a tray for conveying pouches for flexible containers, such as Doypacks and the like, and to methods and machines for manufacturing flexible containers using such tray.

BACKGROUND

Pouches for flexible containers such as Doypacks and the like are conceived to be filled with a substance such as a liquid, a powder or a purée, for example a beverage or a purée of fruit, and to be sealed to contain and preserve the substance. These pouches can optionally be associated with a rigid spout, which is fixed between the flaps of the walls of the pouch and also can be sealed, for example by a screw-on cap.

These pouches are typically manufactured in a place that is different from the one where they are filled. In particular, they are supplied by a first subject (the manufacturer) and transported to a second subject (located geographically in a different position with respect to the first subject), which uses them in its own filling line.

For transport, the pouch manufacturer typically resorts to cardboard boxes, in which the pouches, grouped into packs of a certain number of stacked pouches, are arranged so as to fill substantially the entire volume of the box and maximize the occupied space. For this reason, the insertion of the packs of pouches into the box is normally performed without paying attention to the orientation of the pouches, i.e., without discriminating as how the mouth is oriented or how the bottom of the pouch is oriented with respect to the bottom of the box.

This practice of the background art is not free from drawbacks, among which it is appropriate to report the fact that the operator of the filling line must open the box, pick up a pack of pouches, eliminate the strap or the elastic that keeps them grouped, determine the orientation of the mouth of the group of pouches, and load this group correctly in the pouch feeding station of the filling line.

This activity entails a waste of time on the part of the operator and does not allow automation of the procedure for loading the pouches from the box to said feeding assembly, in view of the random arrangement of the packs of pouches in the box provided by their manufacturer.

A similar problem can arise in cases in which the manufacture of the pouches occurs proximate to the filling line, since the pouches, even though the machine that manufactures them is located nearby, must in any case be conveyed toward the pouch feeding station of the filling line.

SUMMARY

The aim of the present disclosure is to provide a pouch container that is capable of improving the background art in one or more of the aspects indicated above.

Within this aim, the disclosure provides a pouch container that allows to provide the operator of the filling line with a tool so that he does not need to pay attention to the arrangement of the pouches received from the manufacturer.

The disclosure also provides a pouch container that allows automation of their loading at the inlet of a filling line and/or at the outlet of a pouch manufacturing machine.

Moreover, the present disclosure provides a pouch container that can be reused.

In greater detail, the present disclosure seeks to provide a pouch container which, after its use, can be stored or returned to the manufacturer, occupying a reduced volume.

Furthermore, the present disclosure overcomes the drawbacks of the background art in a manner that is alternative to any existing solutions.

The disclosure provides a pouch container that is highly reliable, relatively easy to provide and at competitive costs.

This aim, as well as these and other advantages which will become better apparent hereinafter, are achieved by providing the use of a tray for conveying pouches for flexible containers such as Doypacks and the like, characterized in that said tray comprises a plurality of partitions that protrude from the base of the tray so as to form between them spaces for containing packs of pouches for flexible containers, said containment spaces being used to contain said packs of pouches in a direction that is transverse to said partitions.

The aim and advantages of the disclosure are also achieved by providing a method for manufacturing pouches of flexible containers such as Doypacks and the like, comprising the steps of

- mutual coupling of a plurality of films or portions of a same film folded onto itself, in order to obtain a ribbon provided with a plurality of pockets;
- cutting the ribbon to form a plurality of pouches, and characterized in that it comprises a step of insertion of said pouches in said tray.

Preferably, after said cutting step, said method comprises a step for grouping said pouches into at least one pack, said insertion step including inserting said at least one pack in said tray.

The aim and advantages of the disclosure are also achieved by providing a machine for manufacturing pouches for flexible containers such as Doypacks and the like, comprising means for the mutual coupling of a plurality of films or of portions of a same film folded onto itself, in order to obtain a ribbon provided with a plurality of pockets, and comprising means for cutting said ribbon in order to obtain a plurality of pouches, characterized in that it comprises means for the insertion of said pouches in at least one tray such as the one cited above.

The aim and advantages of the disclosure are also achieved by providing a method for filling pouches for flexible containers such as Doypacks and the like, comprising a step of feeding said pouches to a pouch feeding station and a subsequent step of filling said pouches with a substance such as a fluid, a powder or a purée, characterized in that said pouch feeding step comprises:

- providing at least one tray like the one cited above and containing a plurality of said pouches grouped in packs and oriented concordantly in said tray containment space;
- picking up said pouches from the tray;
- releasing said pouches in said pouch feeding station.

The aim and advantages of the disclosure are further achieved by providing a line for filling pouches for flexible containers such as Doypacks and the like, comprising a pouch feeding station and a station for filling said pouches, which is arranged downstream of said feeding station, characterized in that said feeding station is associated in input with a support of at least one tray such as the one cited above and with grip means configured to pick up the pouches from said tray and release them to said pouch feeding station.

BRIEF DESCRIPTION OF THE DRAWINGS

Further characteristics and advantages of the disclosure will become better apparent from the description of a preferred but not exclusive embodiment of the tray for conveying pouches for flexible containers according to the disclosure, illustrated by way of nonlimiting example in the accompanying drawings, wherein.

DETAILED DESCRIPTION OF THE DRAWINGS

Figure 1:
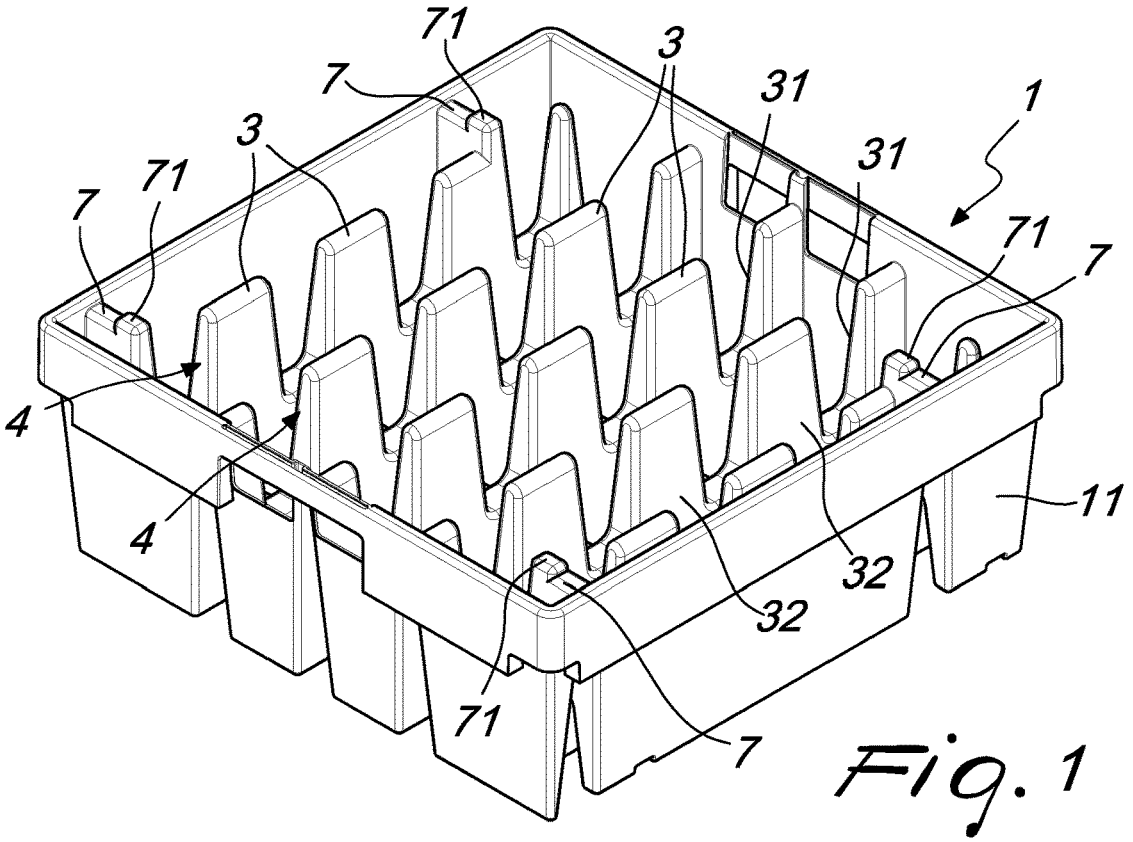
FIG. 1 is a top perspective view of a tray according to the disclosure.
Figure 2:
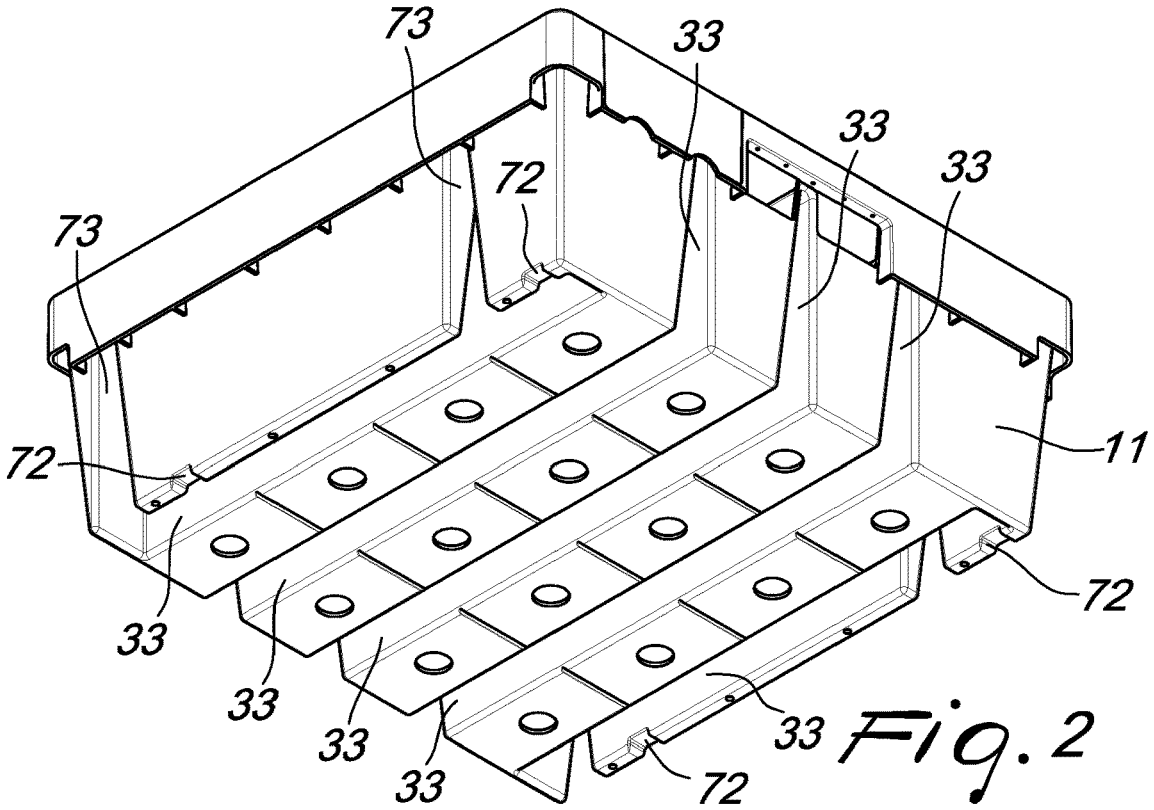
FIG. 2 is a perspective view from below of the tray of the preceding figure.

With reference to the FIGS. 1-10, a tray according to the disclosure, designated generally by the reference numeral 1, comprises a base 2 from which multiple partitions 3 protrude which are arranged preferably on substantially mutually parallel rows 4, so as to form between the partitions 3, and in particular between each pair of adjacent rows 4, transverse containment spaces 5 for packs 6 of pouches for flexible containers.

In the illustrated embodiment, the tray 1 is shaped like a tub with a quadrangular base and has therefore a basin within which the rows 4 of the partitions 3 are extended, surrounded by a continuous perimetric wall 11.

The tray 1 can be provided by molding a polymeric material such as PVC or can be obtained by deformation of sheet metal.

The containment spaces 5 are used to contain the packs 6 of pouches in a direction that is transverse to the partitions 3 and preferably transverse also to the pouches of the packs 6, so that said pouches rest with one of their edges against the base 2 of the tray 1.

Each pack of pouches 6 comprises, as in the background art, a plurality of pouches which are flattened and stacked in a concordant direction, i.e., with all the mouths of the pouches oriented toward the same side of the pack of pouches.

Advantageously, these packs of pouches 6 are accommodated in the containment spaces 5 so that all the packs 6 have the mouths of the pouches oriented in the same manner in the entire tray 1. In this manner, the human or robotic user does not need to pay attention to the orientation of the packs of pouches 6 when he/she or it has to pick them up from the tray 1 to insert them in the pouch feeding station of the filling line.

The partitions 3 can be simple continuous walls or, preferably, walls provided with discontinuities along the direction of the respective row 4, so that the partitions 3 are at least partly mutually separated along the respective row 4. In particular, multiple open regions 31 are provided along each row 4 and are arranged so that the packs of pouches 6, by resting between two adjacent partitions 3 of the same row 4, have an exposed face on the open region 31 comprised between these two adjacent partitions 3. It is thus possible to facilitate the pickup of the packs of pouches on the part of a human user or of a robotized grip clamp. The hand or clamp can in fact pick up the pack of pouches 6 by gripping the opposite faces of the pack 6, through the open regions 31.

Figure 9:
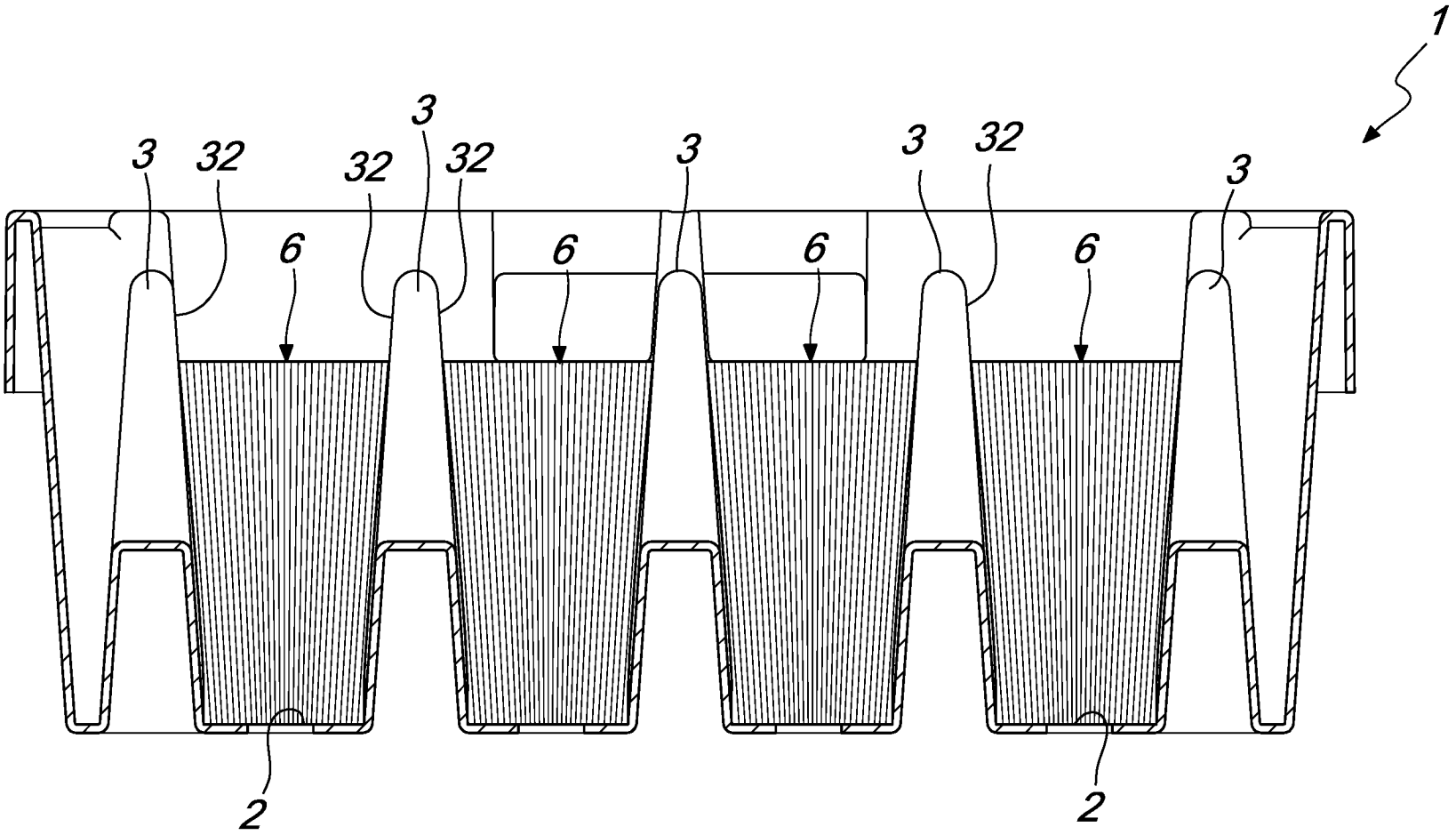
FIG. 9 is a sectional view, taken along the line VIII-VIII of the preceding figure.

The partitions 3 have lateral surfaces 32 which are inclined and preferably converge away from the base 2 of the tray, so as to keep said packs of pouches compressed at the base 2 of the tray, as shown in FIG. 9.

Optionally it is possible to provide on the base 2, in the containment spaces 5, separators 21 which protrude from the base 2 and are directed at right angles to the rows 4 of partitions 3 and are mutually spaced so as to form lateral containment shoulders for the packs of pouches. In a containment space 5, therefore, each pack 6 of pouches is confined transversely by the partitions 3 of two adjacent rows 4 and laterally by at least one of the separators 21.

The partitions 3 are matched by respective first grooves 33 on the face of the base 2 that lies opposite with respect to the one from which the partitions 3 protrude.

Figure 3:
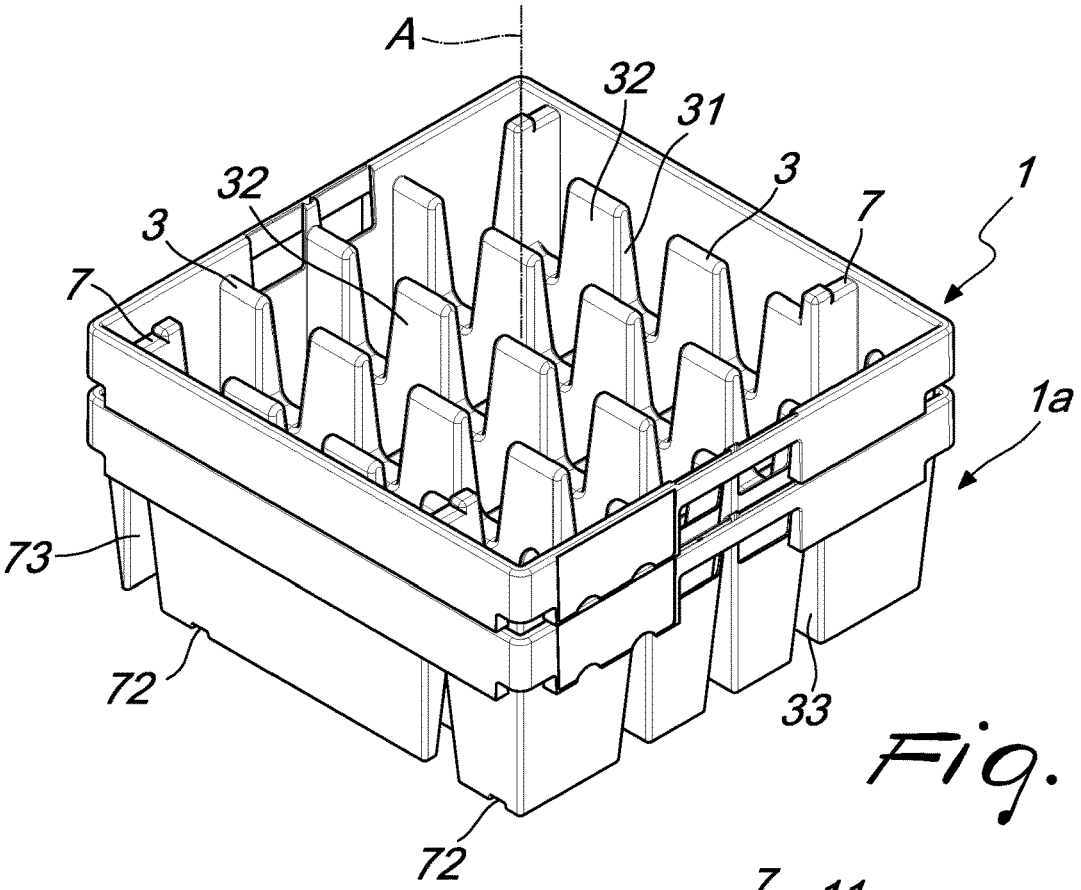
FIG. 3 is a view of two trays that correspond to the tray of FIG. 1 in the nested configuration.
Figure 4:
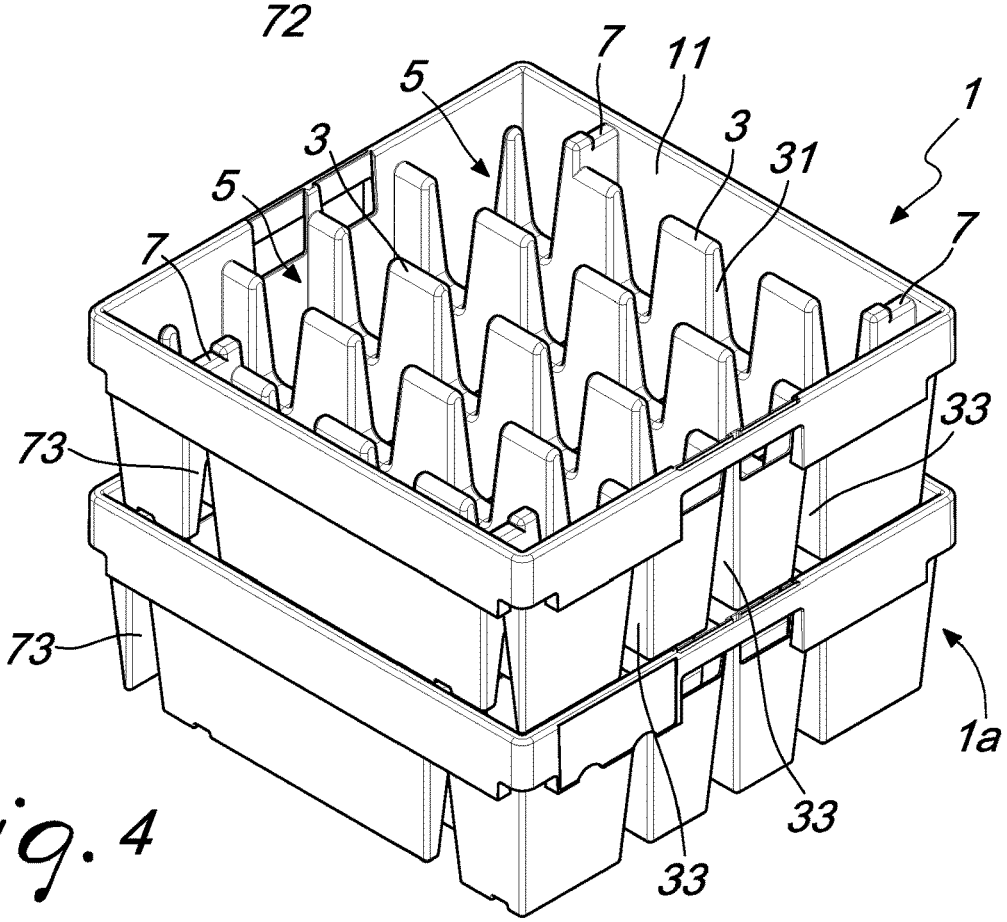
FIG. 4 is a view of the two trays of the preceding figure in the stacked configuration.
Figure 5:
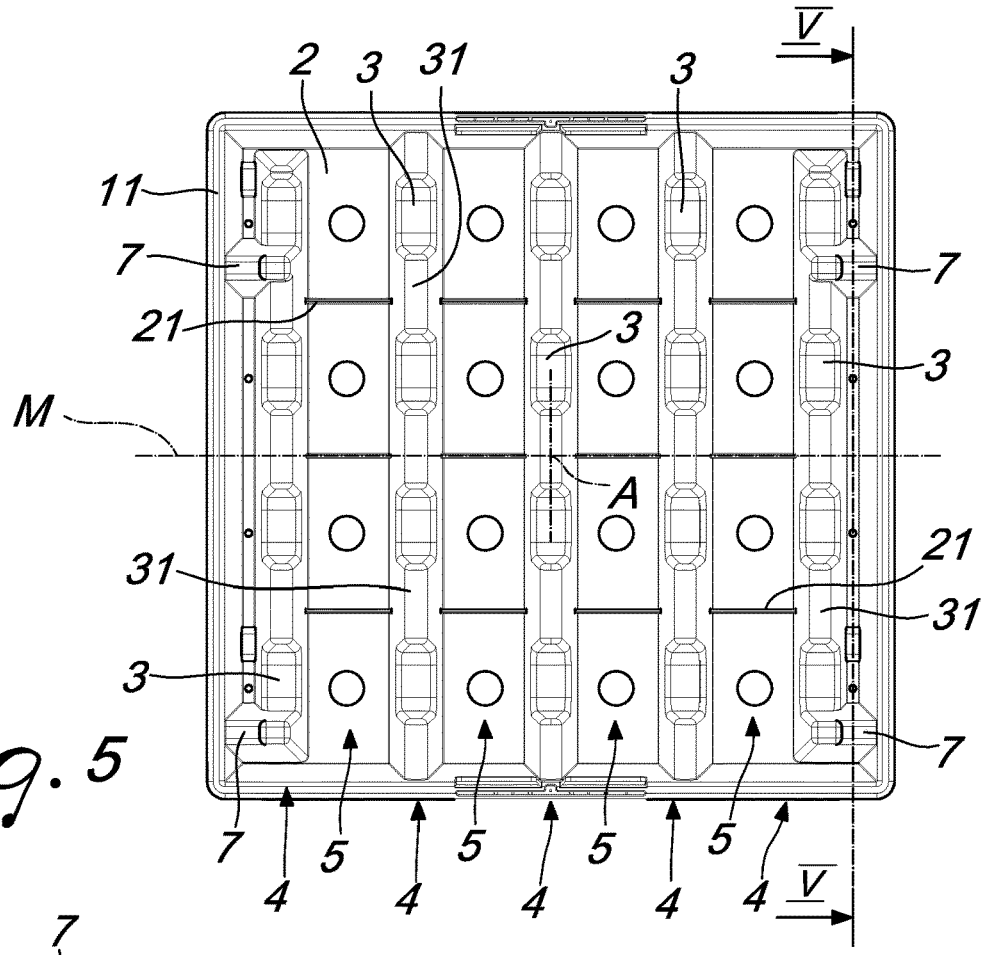
FIG. 5 is a top plan view of the stacked trays of the preceding figure.
Figure 6:
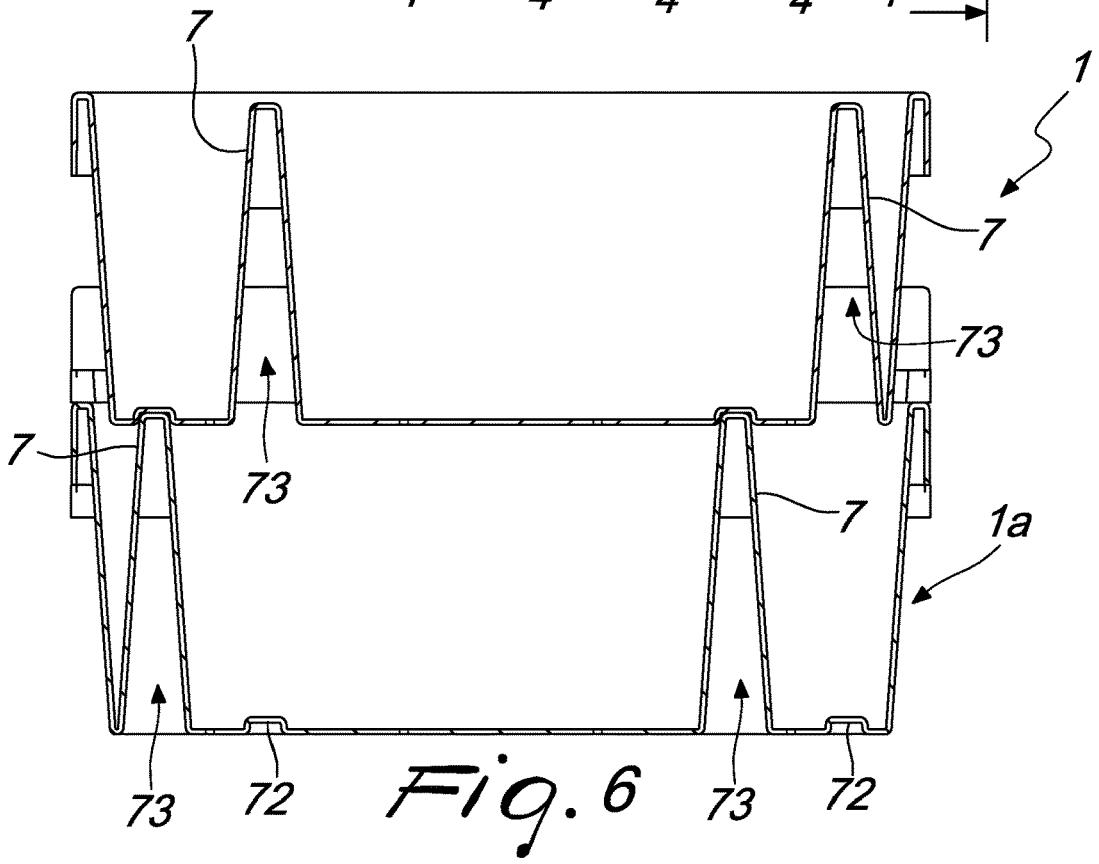
FIG. 6 is a sectional view, taken along the line V-V, of the stacked trays of the preceding figure.
Figure 7:
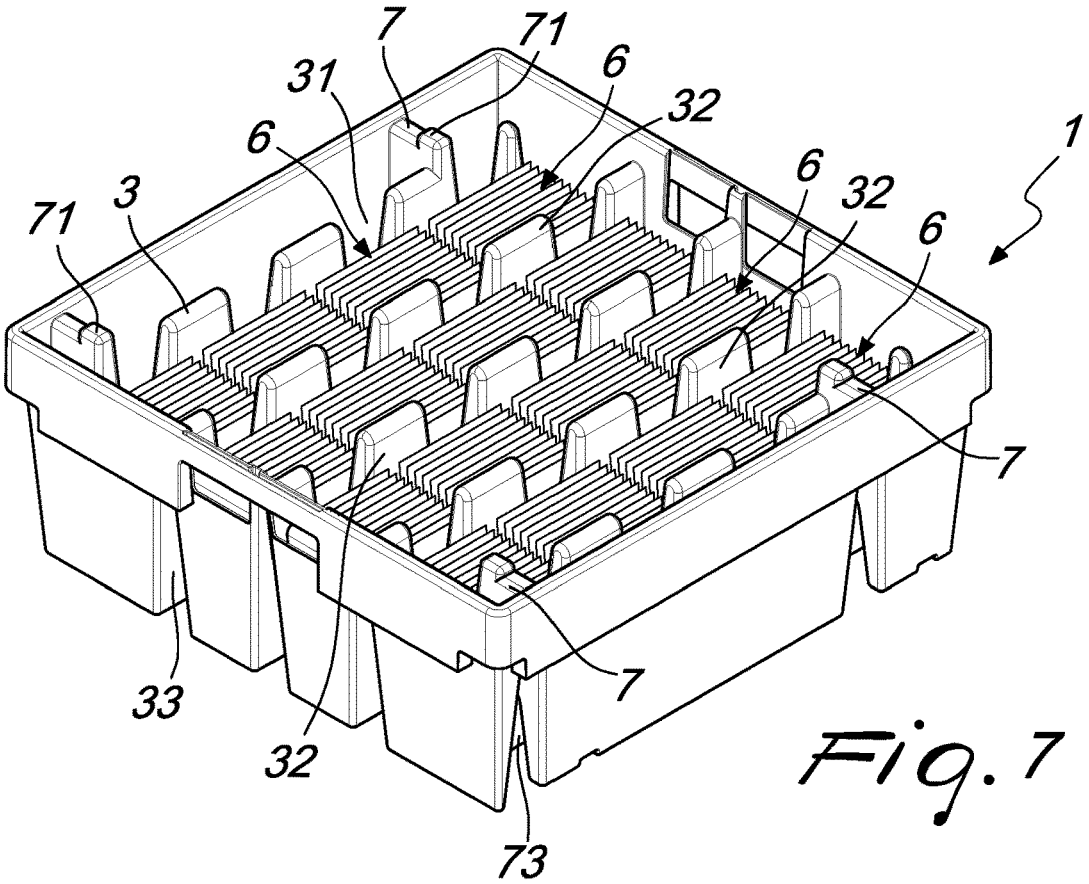
FIG. 7 is a view of the tray of FIG. 1 filled with packs of pouches.
Figure 8:
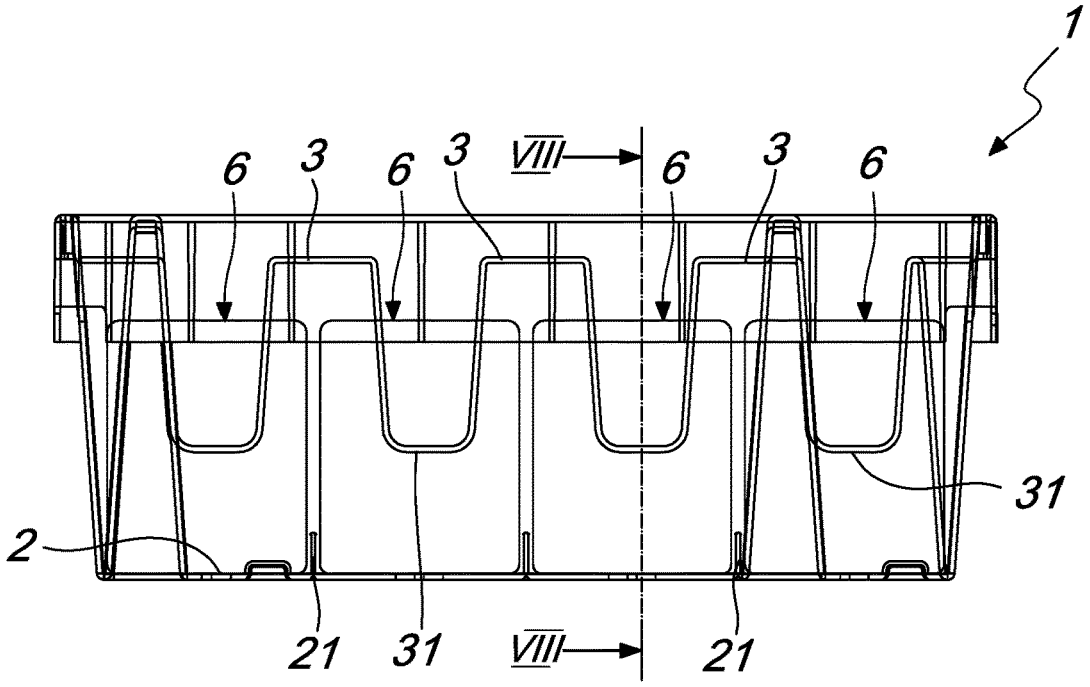
FIG. 8 is a side view in phantom lines of the tray of the preceding figure.

Each one of the first grooves 33 is extended within the respective partition 3 so as to allow the tray 1 to be nested in a second identical tray 1*a* by means of the insertion of the partitions of the second tray 1*a* in the first grooves 33 of the tray 1, as shown in FIG. 3.

The first grooves 33 can be obtained easily during molding of the tray 1. For example, in the case of injection molding, it is possible to form an interspace having a substantially constant thickness, in which the polymeric material is injected and which is corrugated so as to form, on the molded product, the partitions 3, the containment spaces 5 and, inside the partitions 3, the grooves 33. A similar result can be obtained by thermoforming a sheet of thermoformable material or by deformation of sheet metal.

Advantageously, the base 2 of the tray 1 comprises at least four supporting protrusions 7 which are arranged asymmetrically (or in a non-mirror symmetrical manner) with respect to a central plane M of the tray 1. These supporting protrusions 7 are matched by respective second grooves 73 on the face of the base 2 that lies opposite the face from which the supporting protrusions 7 protrude. Each one of the second grooves 73 is extended within the respective supporting protrusion 7 so as to allow said nesting of the tray 1 in the second identical tray 1*a*. However, by virtue of the asymmetric arrangement of the supporting protrusions 7 with respect to the central plane M of the tray 1 it is possible to prevent said nesting by rotating the tray 1 through 180° with respect to the second tray 1*a*, about a central axis A which is substantially perpendicular to the base 2 of the tray 1. This rotation causes the second grooves 73 of the tray 1 to be not aligned with the protrusions 7 of the second tray 1*a*, which accordingly interfere with the base 2 of the tray 1, preventing alignment.

The supporting protrusions 7 can be shaped advantageously so as to prevent slippages of the upper tray, for example by means of a suitable step 71 which engages in a corresponding recess 72 arranged on the lower face of the base 2 of the upper tray 1.

As an alternative to the supporting protrusions 7, one might distribute the rows 4 of partitions 3 source in a manner which is non-mirror symmetrical with respect to a second central plane of the tray 1 that is perpendicular to the plane M and to the base 2. In this manner, the trays might be nested or only stacked by rotating through 180° one tray with respect to the underlying one, the partitions 3 of which would act as supports for the overlying tray when it is in the stacked configuration.

The tray described above can be used advantageously both during the production of the pouches and during their filling.

Figure 10:
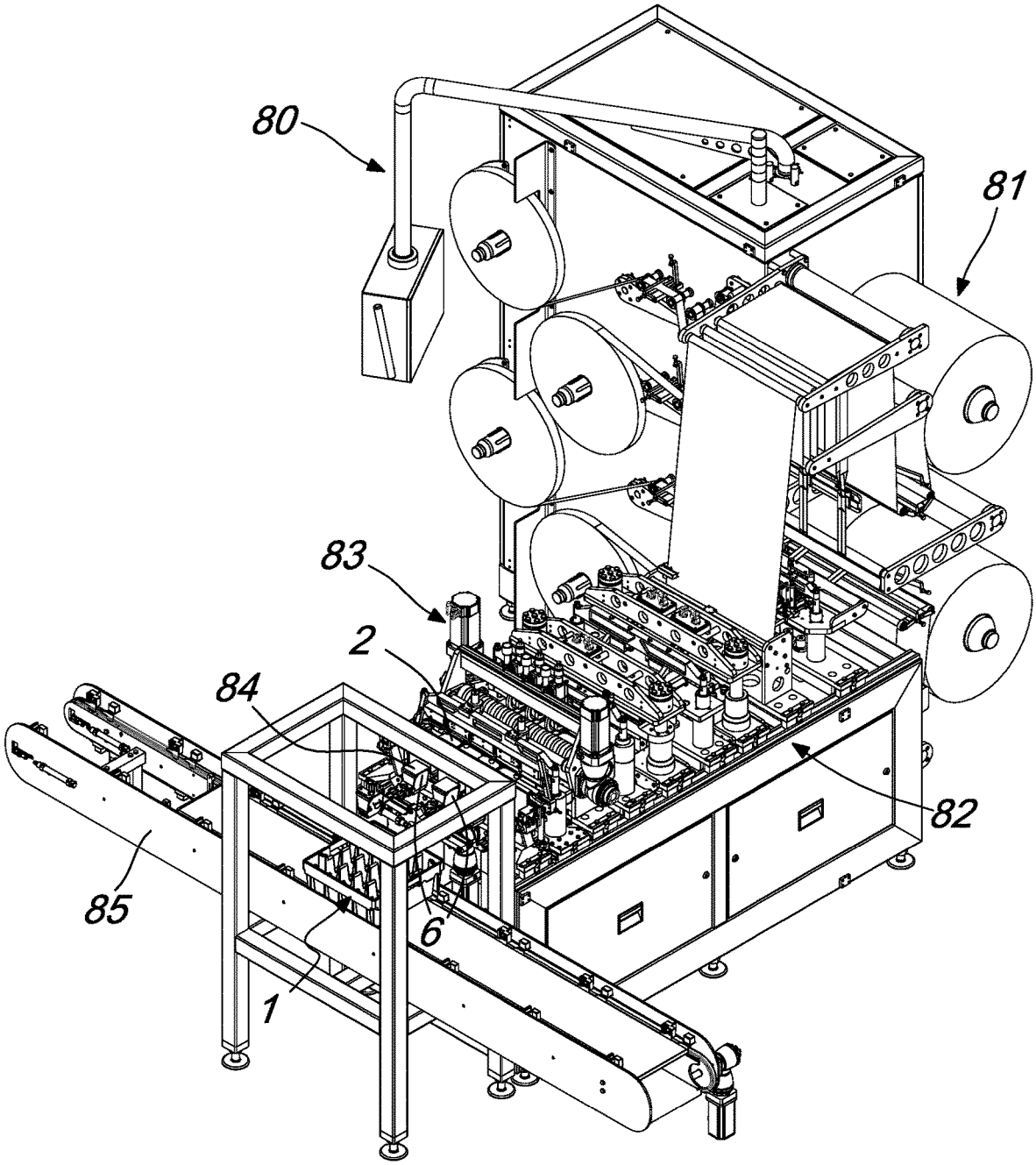
FIG. 10 is a view of a machine for manufacturing pouches and of their loading into a tray according to the disclosure.

With reference to FIG. 10, a method for the production of pouches of flexible containers can comprise the known steps of mutual coupling of a plurality of films, for example a pair of films unwound and tensioned from respective spools of a film feeding station 81.

In an alternative embodiment it is possible to couple two portions of the same film by folding it in half on to itself after unwinding from the spool.

Coupling can occur in an appropriate station 82 by heat-sealing or taping, so that the two films or the folded portions of the same film are stably anchored to each other except for a pocket that remains open and which will form the mouth of the pouch 2.

The multilayer ribbon obtained with this coupling is provided with a plurality of pockets and can be cut in a subsequent cutting or die-cutting station 83 in order to form a plurality of pouches 2.

Finally, insertion means 84, for example grip clamps, can pick up a group or pack 6 of stacked pouches 2 and insert them in the containment spaces 5 of a tray 1 according to the disclosure, conveniently fed by means of a conveyor belt 85. In the insertion step the grip clamps release the packs 6 into the tray 1 so that they are all oriented in the same manner, as explained earlier.

The trays 1 can be placed at the inlet of the conveyor belt 85 in a nested configuration, so as to save space, and an operator or a robot can extract them individually and release them onto the conveyor belt.

Once filled, the trays 1 can be stacked in succession by rotating them through 180° with respect to each other and can be removed by means of a trolley, in order to take them to a filling line arranged nearby or to box them and load them onto a vehicle for delivery to a remote filling line.

It is possible to associate the pouch manufacturing machine 80 described above with a filling line by means of the interposition of a buffer in which the trays 1 filled with pouches are accumulated, if the production and filling speeds are not the same.

The filling line on which the trays 1 filled with pouches are conveyed may be any. In any case, it has at the inlet a pouch feeding station, for example the one described in WO2016/03495644 or in patent application US2003/0216235. Said feeding station can be associated with a support for the tray 1, which can be also just the floor or the trolley that carries the trays, and is located upstream of a filling station, for example a filling carousel, which receives the pouches directly or indirectly from the feeding station, for example by means of intermediate transfer carousels.

An operator or a robot, for example a collaborative robot, can pick up the packs of pouches 6 from the tray 1 that it has received without paying attention to the corresponding orientation and load it as it is in the feeding station, for example in a magazine of said station.

In practice it has been found that the tray according to the disclosure fully achieves the intended aim, since it allows to arrange in an orderly manner the packs of pouches normally provided by the corresponding manufacturers and allows the corresponding automatable filling in the feeding station of a pouch filling line.

The trays can be reused and in particular can be returned to the pouch manufacturer by nesting them one inside the other in order to save space.

The tray thus conceived is susceptible of numerous modifications and variations, all of which are within the scope of the appended claims; all the details may furthermore be replaced with other technically equivalent elements.

In practice, the materials used, as well as the dimensions, may be any according to the requirements and the state of the art.

The disclosures in Italian Patent Application no. 102016000079213 (UA2016A005573), from which this application claims priority, are incorporated herein by reference.

The invention claimed is:

1. Use of a tray for conveying pouches for flexible containers, said tray comprising: a plurality of partitions that protrude from the base of the tray so as to form containment spaces between the partitions, said spaces configured for containing packs of pouches for flexible containers, said containment spaces being used to contain said packs of pouches in a direction that is transverse to said partitions, so that the pouches of each pack are stacked within each containment space with their edges facing the base of the tray, wherein said partitions are matched by respective first grooves on an opposite face of said base which is opposite with respect to a face from which the partitions protrude, each one of said first grooves extending within the respective partition so as to allow said tray to be nested in a second identical tray, by means of the insertion of the partitions of said second tray in said first grooves of said tray.

2. The use according to claim 1, wherein said partitions are arranged in substantially mutually parallel rows, each pair of adjacent rows forming between them one of said containment spaces for the packs of pouches.

3. The use according to claim 2, wherein said partitions are at least partly mutually separated along the respective row, so as to form a plurality of open regions along each row which are adapted to facilitate the pickup of said packs of pouches.

4. The use according to claim 1, wherein said packs of pouches each comprise a plurality of flattened pouches stacked in a concordant direction, each of said flattened pouches comprising a mouth and being stacked in said packs so that all the mouths are oriented toward a same side of the pack of pouches.

5. The use according to claim 1, wherein each containment space is used to contain said packs of pouches with mouths of pouches of the packs oriented in the same manner in the entire tray.

6. The use according to claim 1, wherein each containment space is used to contain said packs of pouches in a direction that is transverse to said pouches.

7. The use according to claim 1, wherein said partitions have lateral surfaces which are inclined and converge away from a base of the tray, so as to keep said packs of pouches compressed at said base of the tray.

8. The use according to claim 1, wherein the base of said tray comprises supporting protrusions arranged asymmetrically or in a non-mirror symmetrical manner with respect to a central plane of said tray, wherein said supporting protrusions are matched by respective second grooves on the opposite face of said base with respect to the face from which said supporting protrusions protrude, each of said second grooves being extended within the respective supporting protrusion so as to allow a nesting of said tray in said second identical tray or so as to prevent said nesting when said tray is rotated through 180° with respect to the second tray about a central axis of the tray.

9. The use according to claim 7, wherein said containment space comprises a plurality of separators that protrude from said base, are directed transversely to said rows of partitions and are mutually spaced so as to form shoulders for a lateral containment of said packs of pouches.

10. A method for manufacturing pouches of flexible containers, the method including the following steps:

mutual coupling a plurality of films or portions of a same film folded onto itself, in order to obtain a ribbon provided with a plurality of pockets, cutting the ribbon to form a plurality of pouches, and further including:

after said cutting step, grouping said pouches into at least one pack, and inserting said pouches in the tray used according to claim 1, said insertion step consisting in the insertion of said at least one pack in said tray.

11. A method for filling pouches for flexible containers, comprising a step of feeding said pouches to a pouch feeding station and a subsequent step of filling said pouches with a substance such as a fluid, a powder or a pure, said pouch feeding step comprising:

providing at least one tray used according to claim 1 containing a plurality of said pouches grouped in packs and oriented concordantly in said tray containment space;

picking up said pouches from the tray;

releasing said pouches in said pouch feeding station.

* * * * *